US007437821B2

(12) United States Patent
Oh

(10) Patent No.: US 7,437,821 B2
(45) Date of Patent: Oct. 21, 2008

(54) ELECTRIC RAZOR HAVING DOUBLY LATCHED NET SUPPORT

(76) Inventor: Tae-Jun Oh, Bupyeong 6-ri, Jingeop-eup, Namyangju-shi, 472-864, Gyeonggi-do (KR)

( * ) Notice: Subject to any disclaimer, the term of this patent is extended or adjusted under 35 U.S.C. 154(b) by 101 days.

(21) Appl. No.: 11/454,337

(22) Filed: Jun. 16, 2006

(65) Prior Publication Data

US 2006/0283018 A1 Dec. 21, 2006

(30) Foreign Application Priority Data

Jun. 21, 2005 (KR) ..... 20-2005-0017812 U

(51) Int. Cl.
*B26B 19/04* (2006.01)

(52) U.S. Cl. ..... 30/43.92; 30/345.51

(58) Field of Classification Search ..... 30/43.6, 30/43.9, 43.92, 346.51
See application file for complete search history.

(56) References Cited

U.S. PATENT DOCUMENTS 3,325,893 A * 6/1967 Trouilhet ..... 30/43.92
3,501,835 A * 3/1970 Moret et al. ..... 30/43.92
3,783,508 A * 1/1974 Brown et al. ..... 30/43.92
3,967,372 A * 7/1976 Beck et al. ..... 30/34.1
3,967,374 A * 7/1976 Boiten ..... 30/43.92
3,997,969 A * 12/1976 Czerner et al. ..... 30/43.92
3,999,291 A * 12/1976 Boer ..... 30/43.92
4,606,122 A * 8/1986 Ullmann et al. ..... 30/43.92
4,837,929 A * 6/1989 Tanahashi et al. ..... 30/43.92
4,991,295 A * 2/1991 Messinger ..... 30/43.92
5,058,270 A * 10/1991 Deubler et al. ..... 30/34.05
5,163,227 A * 11/1992 Wolf et al. ..... 30/43.92
5,542,179 A * 8/1996 Beutel ..... 30/43.92
6,205,666 B1 * 3/2001 Junk ..... 30/43.92
6,415,513 B1 * 7/2002 Eichhorn et al. ..... 30/43.92

* cited by examiner

*Primary Examiner*—Hwei-Siu C. Payer
(74) *Attorney, Agent, or Firm*—Cantor Colburn LLP

(57) ABSTRACT

An electric razor having a doubly latched net support includes a body unit containing a drive motor, and a head unit coupled to the body unit. The head unit includes a head body, a cutting blade assembly received in the head body, and the net support having a safety net and coupled to the cutting blade assembly and the head body. The head body has seating recesses formed in a bottom thereof, shock-absorbing springs received in the seating recesses, respectively, upper and lower buttons embedded in opposite sidewalls thereof, and upper and lower stepped portions formed at the inner surfaces of the sidewalls thereof. The net support further has supporting bars extending downward from a lower end thereof to be inserted, respectively, into the seating recesses formed in the bottom of the head body, and outwardly inclined latches provided at upper ends of the supporting bars, respectively.

1 Claim, 5 Drawing Sheets

ELECTRIC RAZOR HAVING DOUBLY LATCHED NET SUPPORT

BACKGROUND OF THE INVENTION

1. Field of the Invention

The present invention relates to an electric razor having a doubly latched net support, and more particularly, to an electric razor in which a net support having a safety net is latched doubly to a head unit by upper and lower stepped portions formed at inner surfaces of opposite sidewalls of a body of the head unit, thereby enabling easy discharge of impurities such as cut beard, etc. after completing a shaving operation.

2. Description of the Related Art

In the case of a conventional electric razor, a net cap is formed along an upper peripheral edge thereof with a protruded portion such that three subsidiary elements including a cylinder having screw threads, net plate, and rotary shaft are assembled to an inner peripheral wall of the net cap. The net cap, in turn, is coupled to a head unit of the electric razor containing cutting blades therein by use of screw threads formed at an outer peripheral wall of the head unit. In this structure, to clean the cutting blades and the interior of the head unit, the net cap must be completely separated from the head unit, resulting in troublesome separation/coupling operations. Furthermore, in the manufacture of the conventional electric razor, there is a trouble in that the inner protruded portion of the metallic net cap, screw threads, etc. must be milled individually by means of lathes.

SUMMARY OF THE INVENTION

Therefore, the present invention has been made in view of the above problems, and it is an object of the present invention to provide an electric razor having a doubly latched net support for enabling easy discharge of impurities such as cut beard, etc. after completing a shaving operation.

In accordance with the present invention, the above and other objects can be accomplished by the provision of an electric razor having a doubly latched net support comprising: a body unit containing a drive motor therein; and a head unit coupled to an upper end of the body unit and including a head body, a cutting blade assembly received in the head body, and the net support having a safety net and tightly coupled to a top of the cutting blade assembly while being also coupled to the head body, wherein the head body of the head unit has: seating recesses formed in a bottom thereof at opposite side locations of the bottom; shock-absorbing springs received in the seating recesses, respectively; and upper and lower buttons embedded in opposite sidewalls thereof to be fixedly inserted into upper and lower fittings integrally formed at inner surfaces of the sidewalls, wherein the head body of the head unit further has upper and lower stepped portions formed at the inner surfaces of the sidewalls thereof, the upper stepped portions being located above the upper buttons, and the lower stepped portions being located between the upper and lower buttons, and wherein the net support further has: supporting bars extending downward from a lower end thereof to be inserted, respectively, into the seating recesses formed in the bottom of the head body at opposite side locations of the bottom; and outwardly inclined latches provided at upper ends of the supporting bars, respectively.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be explained in detail with reference to the accompanying drawings.

Figure 1:
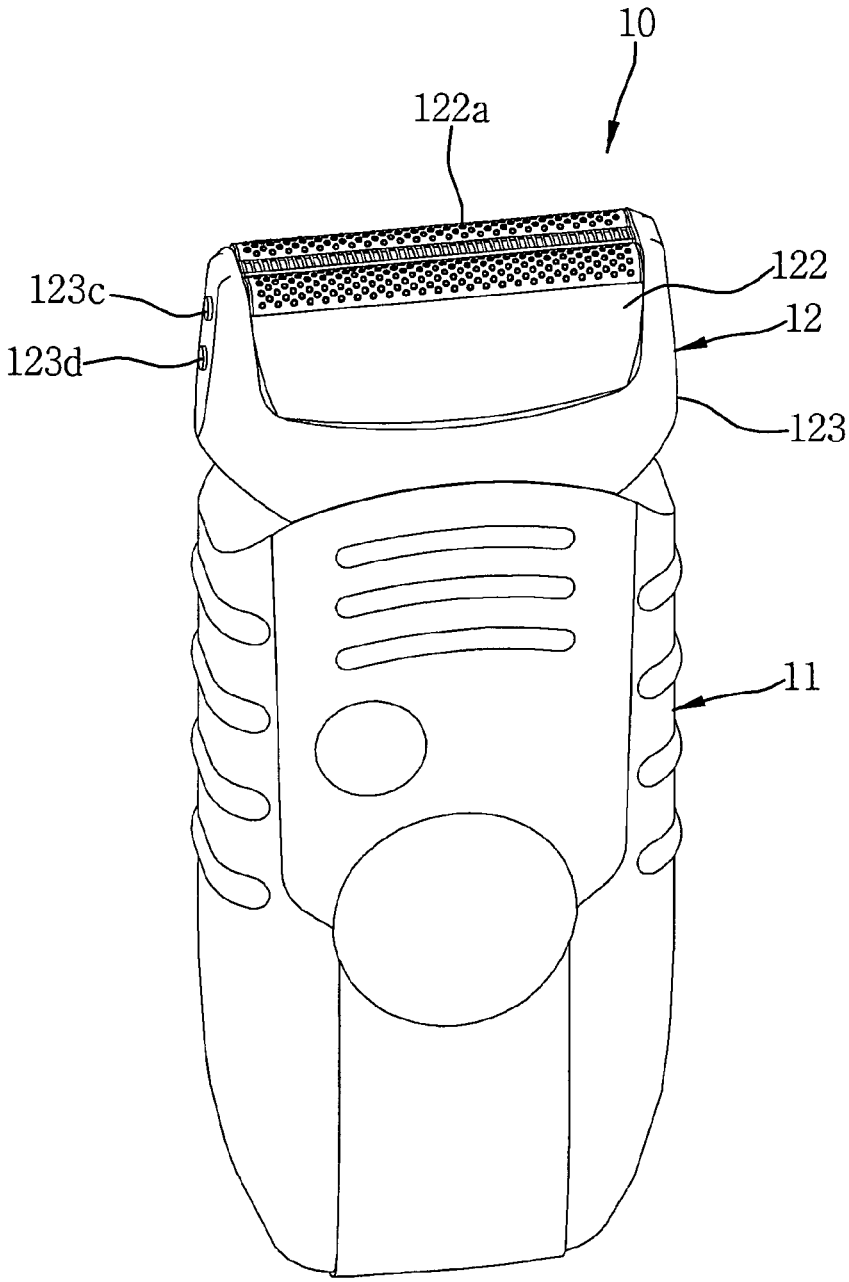
FIG. 1 is a perspective view schematically illustrating the outer configuration of an electric razor having a doubly latched net support according to the present invention.
Figure 2:
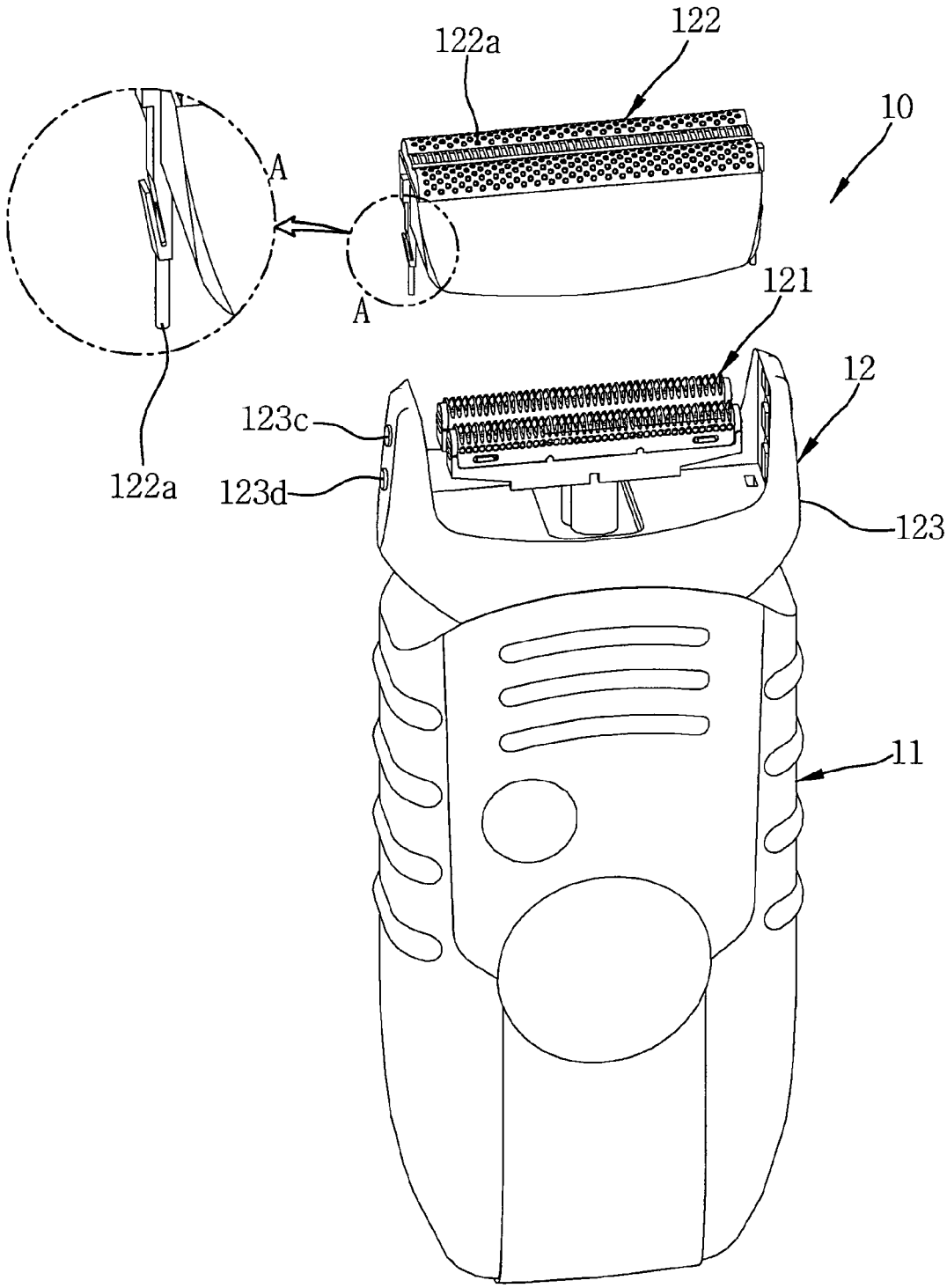
FIG. 2 is a perspective view illustrating the net support separated from the electric razor according to the present invention.
Figure 3:
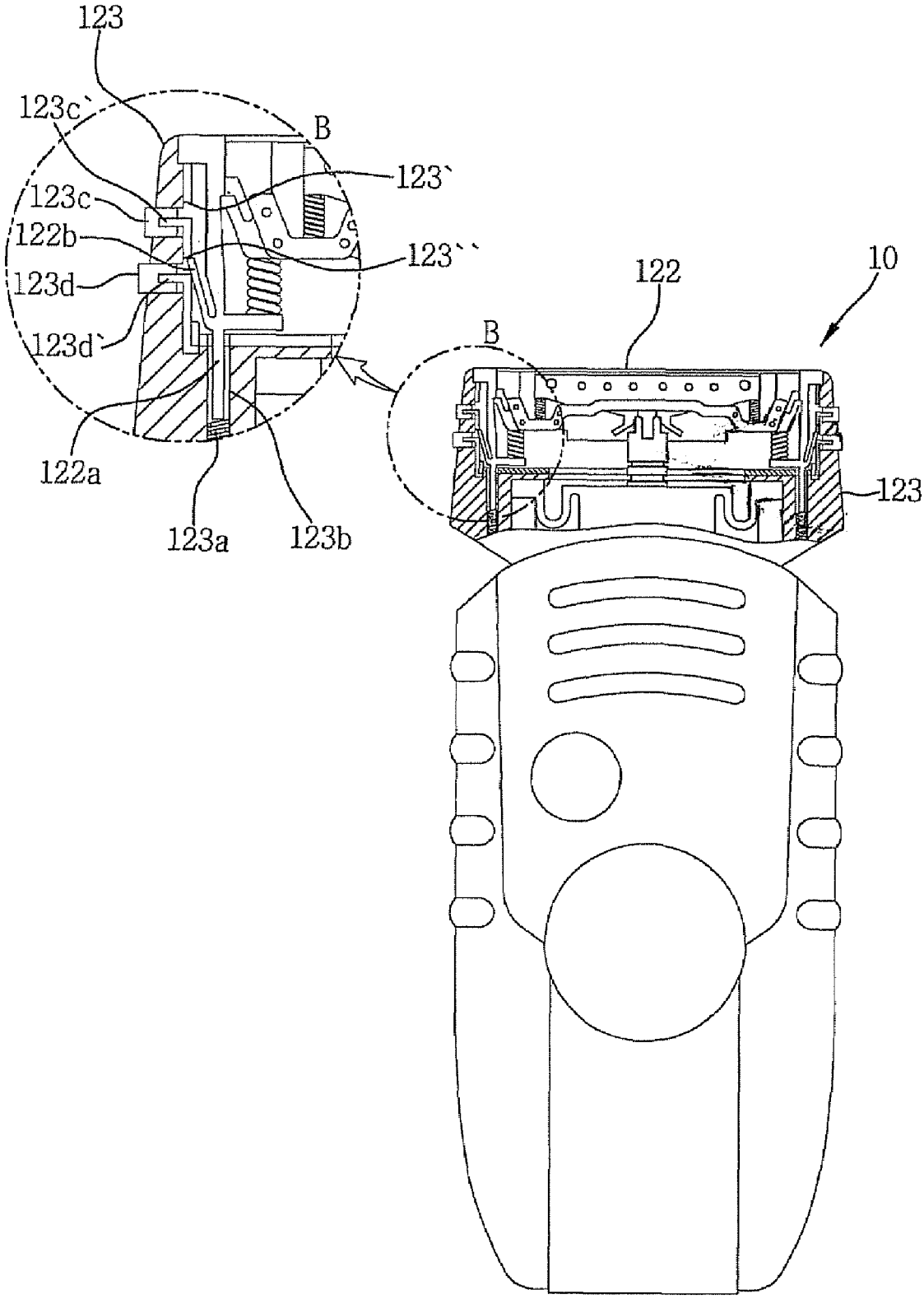
FIG. 3 is a sectional view illustrating a latch of the net support latched to a lower stepped portion of a head unit of the electric razor according to the present invention.
Figure 4:
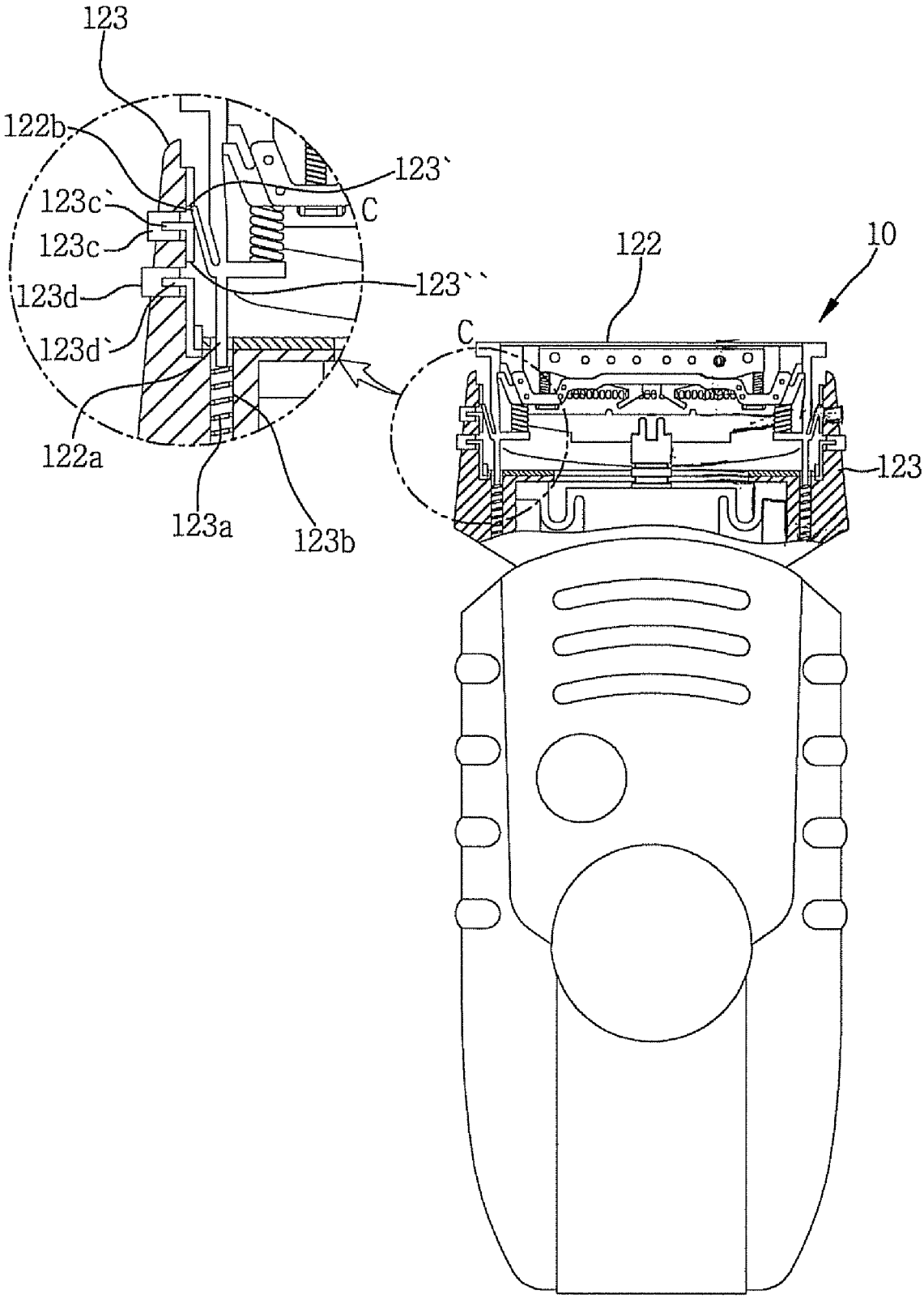
FIG. 4 is a sectional view illustrating a latch of the net support latched to an upper stepped portion of the head unit of the electric razor according to the present invention.
Figure 5:
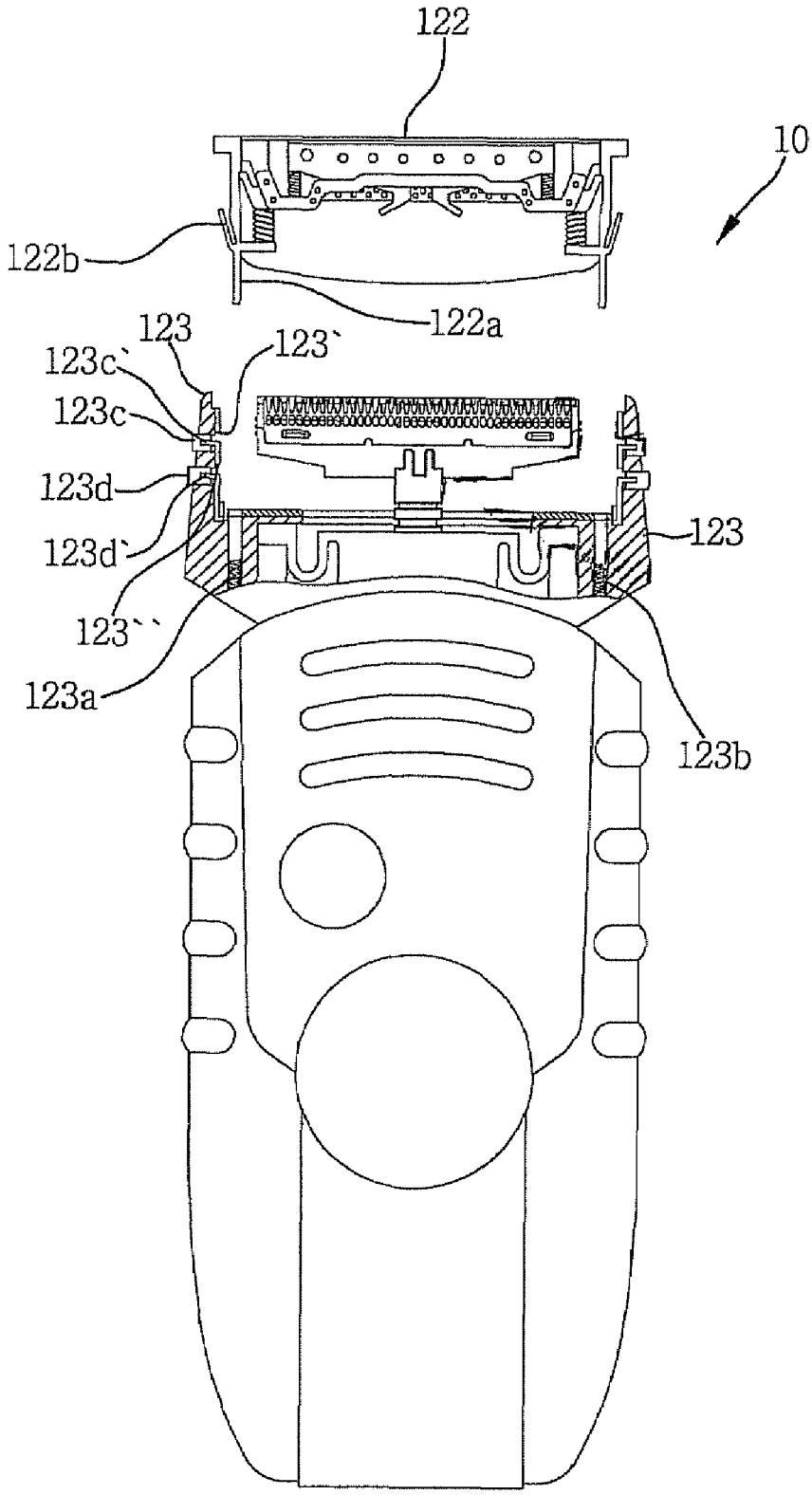
FIG. 5 is a partial sectional view illustrating the head unit of the electric razor according to the present invention.

Explaining the accompanying drawings, FIG. 1 is a perspective view schematically illustrating the outer configuration of an electric razor having a doubly latched net support according to the present invention, FIG. 2 is a perspective view illustrating the net support separated from the electric razor, FIGS. 3 and 4 are sectional views illustrating a latch of the net support latched to a lower or upper stepped portion of a head unit of the electric razor, and FIG. 5 is a partial sectional view illustrating the head unit of the electric razor.

In the present invention, as stated above, it should be noted that the electric razor 10 of the present invention includes a net support having a safety net, which is latched doubly to a head unit by upper and lower stepped portions formed at inner surfaces of opposite sidewalls of a body of the head unit, thereby enabling easy discharge of impurities such as cut beard, etc. after completing a shaving operation.

Specifically, the electric razor 10 having the doubly latched net support basically comprises a body unit 11 containing a drive motor therein, and a head unit 12 coupled to an upper end of the body unit 11. The head unit 12 includes a cutting blade assembly 121 and the net support 122 having a safety net 122*a*' and tightly coupled to a top of the cutting blade assembly 121.

In one outstanding feature of the present invention, the head unit 12 further includes a head body 123 having seating recesses 123*b* formed in a bottom thereof at opposite side locations of the bottom, shock-absorbing springs 123*a* received in the seating recesses 123*b*, respectively, and upper and lower buttons 123*c* and 123*d* embedded in opposite sidewalls of the head body 123 to be fixedly inserted into upper and lower fittings 123*c*' and 123*d*' integrally formed at inner surfaces of the sidewalls of the head body 123.

The head body 123 further has upper and lower stepped portions 123' and 123" formed at the inner surfaces of the sidewalls at positions above the upper buttons 123*c* and between the upper and lower buttons 123*c* and 123*d*, respectively.

In another outstanding feature of the present invention, the net support 122*a*' has supporting bars 122*a* extending downward from a lower end thereof to be inserted into the seating recesses 123*b* formed in the bottom of the head body 123 at opposite side locations of the bottom, and outwardly inclined latches 122*b* formed at upper ends of the supporting bars 122*a*, respectively.

With the present invention having the above described configuration, to remove impurities such as cut beard, etc. after using the electric razor, the lower buttons 123*d* are manually pushed to allow the net support 122 to be moved upward to thereby be separated from the cutting blade assembly 121 for the removal of impurities between the net support 122 and the cutting blade assembly 121. On the other hand, to completely separate the net support 122 from the head body 123, the upper buttons 123*c* are manually pushed.

As apparent from the above description, in the electric razor having the doubly latched net support according to the present invention, when it is desired to remove impurities such as cut beard, etc. after using the electric razor, the lower buttons provided at the body of the head unit are manually pushed, thus allowing the net support to be moved upward within a predetermined range. Also, when it is desired to completely separate the net support from the head unit, the upper buttons provided at the body of the head unit are manually pushed, thus allowing the net support to be moved upward out of the head unit. Accordingly, the present invention has the effect of facilitating easy discharge of impurities such as cut beard, etc. after completing a shaving operation.

Although the electric razor having the doubly latched net support according to the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An electric razor having a doubly latched net support comprising:

a body unit containing a drive motor therein; and a head unit coupled to an upper end of the body unit and including a head body, a cutting blade assembly received in the head body, and the net support having a safety net and tightly coupled to a top of the cutting blade assembly while being also coupled to the head body, wherein the head body of the head unit has: seating recesses formed in a bottom thereof at opposite side locations of the bottom; shock-absorbing springs received in the seating recesses, respectively; and upper and lower buttons embedded in opposite sidewalls thereof to be fixedly inserted into upper and lower fittings integrally formed at inner surfaces of the sidewalls, wherein the head body of the head unit further has upper and lower stepped portions formed at the inner surfaces of the sidewalls thereof, the upper stepped portions being located above the upper buttons, and the lower stepped portions being located between the upper and lower buttons, and wherein the net support further has: supporting bars extending downward from a lower end thereof to be inserted, respectively, into the seating recesses formed in the bottom of the head body at opposite side locations of the bottom; and outwardly inclined latches provided at upper ends of the supporting bars, respectively.

* * * * *